United States Patent [19]

Tamarkin

[11] 3,946,980

[45] Mar. 30, 1976

[54] GUITAR MUSIC CARD CLIP

[76] Inventor: David Tamarkin, 10 Brighton Road, West Hartford, Conn. 06117

[22] Filed: Jan. 23, 1975

[21] Appl. No.: 543,252

[52] U.S. Cl. ..... 248/443; 248/204

[51] Int. Cl.[2] ..... G10G 5/00

[58] Field of Search ..... 248/443, 74 B, 74 PB, 499, 248/510, 328, 204, 231; 24/73 A, 73 HH, 73 HL, 73 TH, DIG. 29, 16 R, 16 PB, 17 A; 224/42.1 B, 5 S, 29 A; 84/329, 453; 40/144, 316, 317

[56] References Cited

UNITED STATES PATENTS

| | | | |
|---|---|---|---|
| 373,767 | 11/1887 | Butler | 24/73 A |
| 487,820 | 12/1892 | Benson | 248/443 |
| 608,438 | 8/1898 | Bye | 248/443 |
| 860,397 | 7/1907 | Lyman | 248/443 |
| 1,942,444 | 1/1934 | O'Connor | 224/42.1 B |
| 2,589,348 | 3/1952 | Diefenbach | 224/29 A |
| 2,728,058 | 12/1955 | Phalen | 248/499 |
| 3,319,917 | 5/1967 | Bilodeau | 248/227 |

*Primary Examiner*—Roy D. Frazier
*Assistant Examiner*—Robert A. Hafer

[57] ABSTRACT

A music holder which may be easily mounted on and removed from a stringed instrument is disclosed. The music holder includes a spring loaded clip which receives and supports cards on which music has been imprinted; the cards being held in the clip in such a manner as to extend generally outwardly from the instrument so as to be easily read. The clip is retained on the instrument by means of an elastic cord provided with hooks at the oppositely disposed ends.

10 Claims, 3 Drawing Figures

GUITAR MUSIC CARD CLIP

BACKGROUND OF THE INVENTION

1. Field of the Invention

The present invention relates to music holders and particularly music holders intended for installation on stringed instruments such as guitars. More specifically, this invention is directed to a music card clip which may be removably attached to the sounding board of a guitar. Accordingly, the general objects of the present invention are to provide novel and improved apparatus of such character.

2. Description of the Prior Art

There have, in the past, been numerous suggestions for music holders which can be attached to stringed instruments. Such portable music holders would, under some circumstances, eliminate the necessity of transporting and using a separate music stand and would prove to be a valuable aid both to the musician and music teacher. A music holder which could be easily installed on and removed from a guitar would, by way of example only, be a valuable aid to a student who could then carry his music with him and practice at any location regardless of the availability of a bulky music stand or adequate fixed position substitute therefore.

In order to have utility a music holder for a guitar must have certain characteristics and attributes. The music holder and the printed material it is intended to receive and support must not interfere with fingering or strumming the instrument. The music holder should also neither mar the finish on the instrument nor interfere with the sound produced thereby. It is also desirable, but not mandatory, that the music holder be inconspicuous. It is highly desirable that the music holder be capable of easy and repeated installation and removal from the instrument.

Prior art music holders designed for mounting on stringed instruments have lacked one or more of the above enumerated desirable features or characteristics. Examples of prior art music holders for instruments such as guitars and violins may be seen in U.S. Pat. Nos. 487,820, 608,438, 857,504 and 3,544,056. The inherent disadvantages of prior art music holders adapted to be attached to stringed instruments are obvious from perusal of the listed patents and thus these patents will not be discussed further.

SUMMARY OF THE INVENTION

The present invention overcomes the above briefly discussed and other deficiencies and disadvantages of the prior art by providing a novel music holder particularly well suited for installation on a guitar. The music holder of the present invention is characterized by a spring clip which receives and holds, in a generally vertical position with respect to the sounding board portion of the guitar body, a card on which music has been imprinted. The clip, which may be provided on its outer surface with a cushion to eliminate the possibility of marring the surface of the instrument, it is slideable along a resilient cord. Hooks are provided at the opposite ends of the resilient cord and these hooks engage the edge of the sound port in the guitar body at either side of the inwardly disposed end of the neck portion of the instrument; the elastic cord passing along the upper surface of the sounding board at either side of the neck and thereafter under the neck.

The guitar music card clip of the present invention, when in use, will support the "cue" cards bearing the music in an easy to read location on the sounding board of the instrument. No tape or glue is needed to hold the cue cards to the instrument and the invention will not interfere with fingering or strumming since the octave ends at the body of the instrument on the standard acoustic guitar. The music card clip of the present invention may be readily installed and removed and can in fact be transported either on the instrument or in the musician's pocket. The music holder of the present invention is designed to avoid the possibility of damage to the instrument and, in so doing, eliminates the mechanical clamp devices which have characterized prior art music holders for stringed instruments.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which:

FIG. 3 depicting a card installed in the music holder as also shown in FIG. 1.

DESCRIPTION OF THE PREFERRED EMBODIMENT

Figure 2:
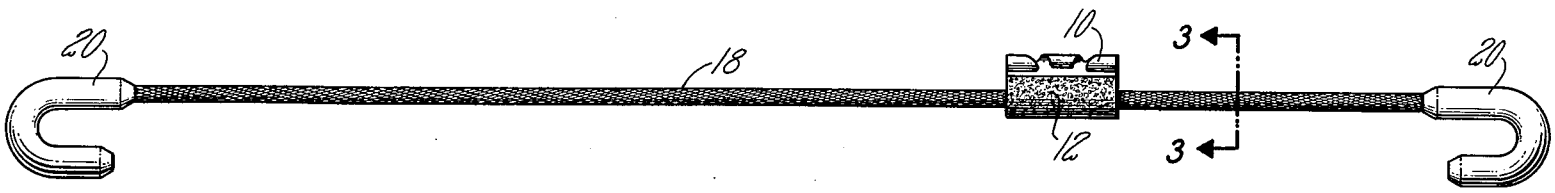
FIG. 2 is an enlarged side elevation view of the music holder shown in FIG. 1.
Figure 3:
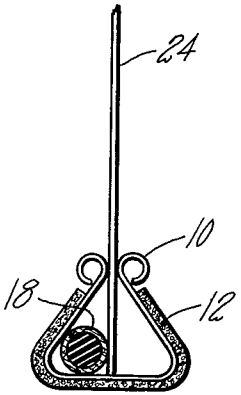
FIG. 3 is a cross-sectional side elevation view, taken along line 3—3, of the music holder of FIG. 2.
Figure 1:
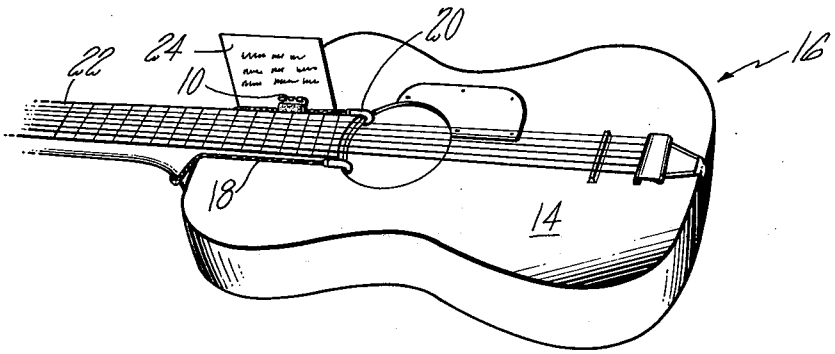
FIG. 1 is a perspective view of a guitar with the music holder of the present invention installed thereon.

With reference now to the drawing, jointly considering FIGS. 1–3, the present invention includes a spring clip 10 of the type wherein the jaws thereof are resiliently biased toward one another. As may best be seen from FIG. 3, clip 10 is provided, on its outer surface, with a pad 12 of a suitable material whereby contact between the clip and the sounding board 14 of a guitar, indicated generally at 16 in FIG. 1, will not result in any marring of the surface of the instrument. Pad 12 will typically be adhesively secured to clip 10 and may be comprised of any suitable foam or sponge-like material having acceptable wear characteristics.

An elastic cord 18 extends through clip 10. Cord 18 is provided, at its opposite ends, with hooks 20. Hooks 20 will be injection molded from a suitable plastic. The hooks may either be molded to the ends of cord 18 or will be formed separately and thereafter inserted on the ends of cord and affixed thereto by crimping.

Referring to FIG. 1, when it is desired to use the music holder of the present invention a first one of hooks 20 is caused to engage the sounding board 14 of the guitar, at the edge of the sound port therein, at a point adjacent to the inner termination of the neck 22 of the instrument. The cord is then extended forwardly along the surface of the sound board, parallel with the neck, to the end of the guitar body and passed under the neck. Thereafter, the elastic cord will be caused to extend rearwardly along the surface of sounding board 14, again in a direction parallel to neck 22, and the second hook 20 will be caused to engage the sound board at the edge of the sound port on the opposite side of the inner end of the neck from the point of engagement of the first hook 20.

After installation of the elastic cord, as described above, the cord will be stretched and the clip 10 moved along the cord until it is properly positioned over the sound board 14. The clip will thereafter be resiliently held in position against the sound board by means of cord 18. A card 24, for example a standard 3 × 5 index card having musical cords imprinted thereon, will be inserted between the closed jaws of clip 10.

The cards, such as card 24 of FIGS. 1 and 3, will remain in a substantially vertical position with respect to the plane defined by the sounding board 14 of guitar 16 because of the positioning of cord 18 in front of the card as clearly shown in FIG. 3. When the guitar 16 is held in the normal playing position gravity will tend to cause the upper edge of the card to rotate downwardly; i.e., in the clockwise direction as the device is shown in FIG. 3. The bottom edge of the card will, however, be stopped from rotating by cord 18 and the cards 24 themselves will have sufficient stiffness so as to not bend in the middle.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A music holder for a stringed instrument, the instrument having a sounding board with a port therein, said holder comprising:

an elongated resilient member;

hook means affixed to said elongated resilient member at the opposite ends thereof, said hook means each having an arcuate instrument engaging portion designed to engage the sounding board of an instrument at the edge of the sound port therein; and a spring clip mounted on said elongated resilient member, said clip being capable of movement along said member, said clip having normally closed jaws for the engagement of music in sheet form to hold the music away from the instrument, said jaws establishing a first linear region of contact with the music sheet and the portion of said resilient member disposed within said clip establishing a second linear region of contact with the music sheet, said second region of contact being displaced from said first region of contact.

2. The music holder of claim 1 further comprising:

cushion means secured to at least part of the exterior surface of said spring clip, said cushion means protecting the finish of the instrument sounding board from marring by said clip.

3. The music holder of claim 1 wherein said elongated resilient member comprises:

an elastic cord.

4. The music holder of claim 2 wherein said elongated resilient member comprises:

an elastic cord.

5. The music holder of claim 1 wherein said hook means each comprise:

a generally U-shaped molded plastic element.

6. The music holder of claim 2 wherein said hook means each comprise:

a generally U-shaped molded plastic element.

7. The music holder of claim 3 wherein said hook means each comprise:

a generally U-shaped plastic element.

8. The music holder of claim 4 wherein said hook means each comprise:

a generally U-shaped molded plastic element.

9. The music holder of claim 3 further comprising:

a music card, said card being received and held between the jaws of said spring clip, said card passing behind the elastic cord within said clip whereby the card is supported by the clip jaws and cord in a position substantially vertical to the instrument sounding board.

10. The music holder of claim 7 further comprising:

a music card, said card being received and held between the jaws of said spring clip, said card passing behind the elastic cord within said clip whereby the card is supported by the clip jaws and cord in a position substantially vertical to the instrument sounding board.

* * * * *